United States Patent [19]

Kasama et al.

[11] Patent Number: 4,589,758

[45] Date of Patent: May 20, 1986

[54] IMAGE FORMING APPARATUS HAVING A PAIR OF OPENABLE HOUSING SECTIONS

[75] Inventors: Nobuhiro Kasama, Yokohama; Mitsuru Kurata, Kawasaki, both of Japan

[73] Assignee: Canon Kabushiki Kaisha, Tokyo, Japan

[21] Appl. No.: 662,502

[22] Filed: Oct. 19, 1984

[30] Foreign Application Priority Data

Oct. 25, 1983 [JP] Japan ..... 58-199579

[51] Int. Cl.[4] ..... G03G 15/20

[52] U.S. Cl. ..... 355/3 FU; 355/14 FU; 219/216

[58] Field of Search ..... 355/3 FU, 14 FU, 3 R, 355/14 R; 219/216

[56] References Cited

U.S. PATENT DOCUMENTS 3,997,262 12/1976 Doi et al. ..... 355/11
4,128,334 12/1978 Yanagawa et al. ..... 355/75
4,285,295 8/1981 Iwao et al. ..... 355/3 FU X
4,384,781 5/1983 Takada ..... 355/3 FU
4,421,401 12/1983 Kagiura et al. ..... 355/14 FU X
4,428,660 1/1984 Matsumoto ..... 355/14 FU X

*Primary Examiner*—A. C. Prescott
*Attorney, Agent, or Firm*—Fitzpatrick, Cella, Harper & Scinto

[57] ABSTRACT

An image forming apparatus has a first housing supporting the entire apparatus, a second housing openable relative to the first housing, image forming means for forming on an image bearing member a toner image corresponding to image information to be recorded, a first and a second rotatable member for holding the image bearing member therebetween and conveying the same to fix the toner image formed by the image forming means on the image bearing member, and resilient means acting to open the second housing relative to the first housing and acting for the pressing between the first rotatable member and the second rotatable member.

16 Claims, 17 Drawing Figures

IMAGE FORMING APPARATUS HAVING A PAIR OF OPENABLE HOUSING SECTIONS

BACKGROUND OF THE INVENTION

1. Field of the Invention

This invention relates to an image forming apparatus for recording desired image information on an image bearing member, such as an electrophotographic copying apparatus, a magnetic photographic apparatus or other electrostatic recording apparatus. Accordingly, the present invention is also applicable to a printer apparatus such as a laser beam printer for recording the output information of a microapparatus or a computer on an image bearing member. Particularly, the present invention relates to an image forming apparatus which is openably divisible into a first housing and a second housing.

2. Description of the Prior Art

As described in U.S. Pat. No. 3,997,262 or U.S. Pat. No. 4,128,334, the so-called openable body type copying apparatuses are known. However, the fixing devices used in these openable body type copying apparatuses are so-called chamber type fixing devices and are not those in which an image bearing member is held between two rollers and conveyed thereby. In the fixing devices used in these openable body type copying apparatuses, heaters individually surrounded by casings are merely disposed above and below the conveyance path of the image bearing member.

U.S. Pat. No. 4,384,781 also discloses a so-called openable body type copying apparatus. In this copying apparatus, however, the pressing operation between fixing rollers is accomplished by operating a handle.

That is, none of the above-described known examples has disclosed resilient means acting to open the body and acting for the pressing between a first rotatable member and a second rotatable member for holding the image bearing member therebetween and conveying the same to fix a toner image on the image bearing member.

SUMMARY OF THE INVENTION

It is an object of the present invention to provide an image forming apparatus whose operability can be improved.

It is another object of the present invention to provide an image forming apparatus which is compact.

It is still another object of the present invention to provide an image forming apparatus in which the number of parts used can be reduced.

It is yet still another object of the present invention to provide an image forming apparatus in which jam processing can be facilitated.

It is a further object of the present invention to provide an image forming apparatus provided with a fixing device which can secure sufficient rigidity even if the number of weighty stays is reduced.

It is still a further object of the present invention to provide an image forming apparatus provided with a fixing device which can be directly incorporated into the image forming apparatus without being made into a unit.

DESCRIPTION OF THE PREFERRED EMBODIMENTS

The present invention will hereinafter be described in detail by reference to the drawings.

In the following description of the principle embodiments, a so-called pressure fixing device for fixing toner images on an image bearing member chiefly by pressure will be described by taking such device as an example, whereas the present invention is not restricted thereto, but is also applicable, for example, to a so-called heat fixing device for fixing toner images on an image bearing member chiefly by heat. That is, the present invention is widely applicable to devices in which the image bearing member bearing a toner image thereon is held between and conveyed by a first rotatable member and a second ratatable member to thereby fix the toner image on the image bearing member. The rotatable members are not restricted to rollers, but include, for example, constructions or the like for moving a belt and widely include any means capable of holding the image bearing member therebetween and conveying the same. Further, any materials which can bear toner images thereon such as paper, plastics, wood, metals, etc. are applicable as the image bearing member.

The principle of the present invention will now be described.

Figure 1:
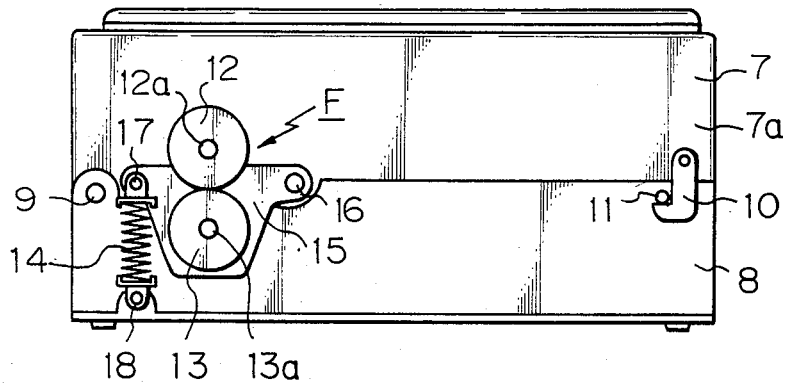
FIGS. 1 to 6 illustrate the principle of the present invention.
Figure 2:
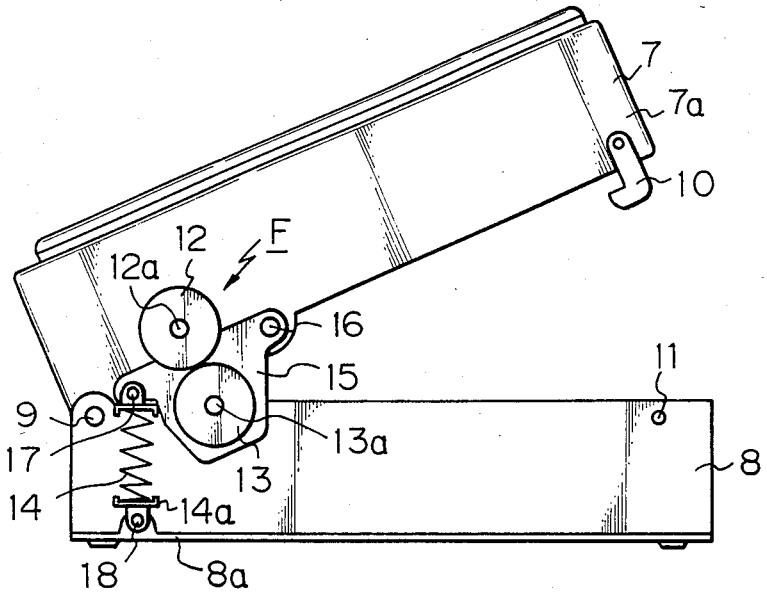
Figure 3:
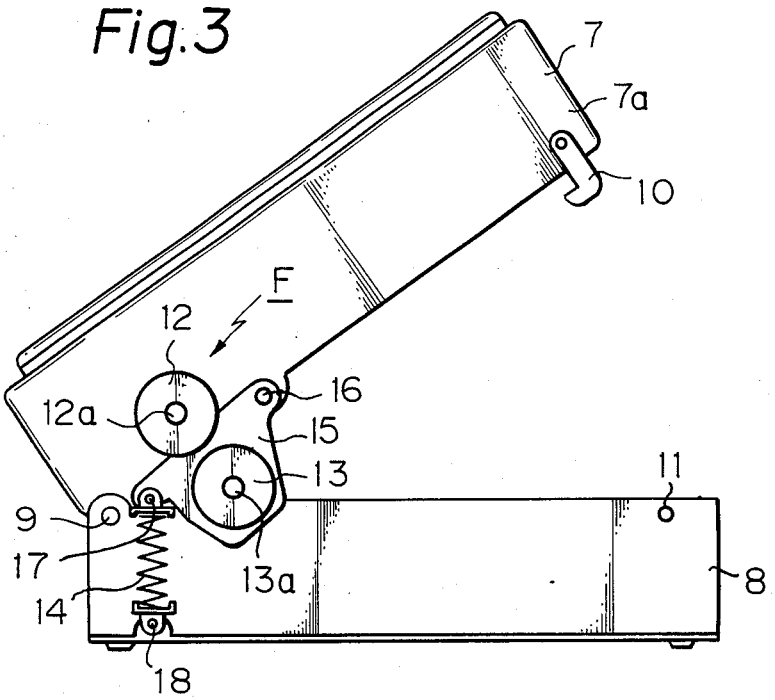
Figure 4:
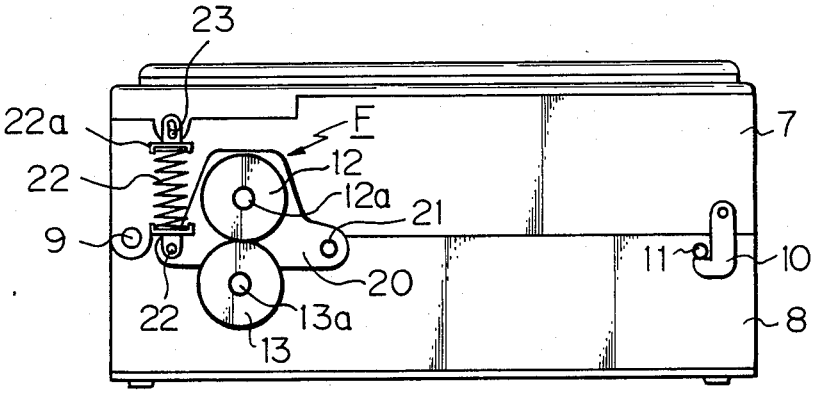
Figure 5:
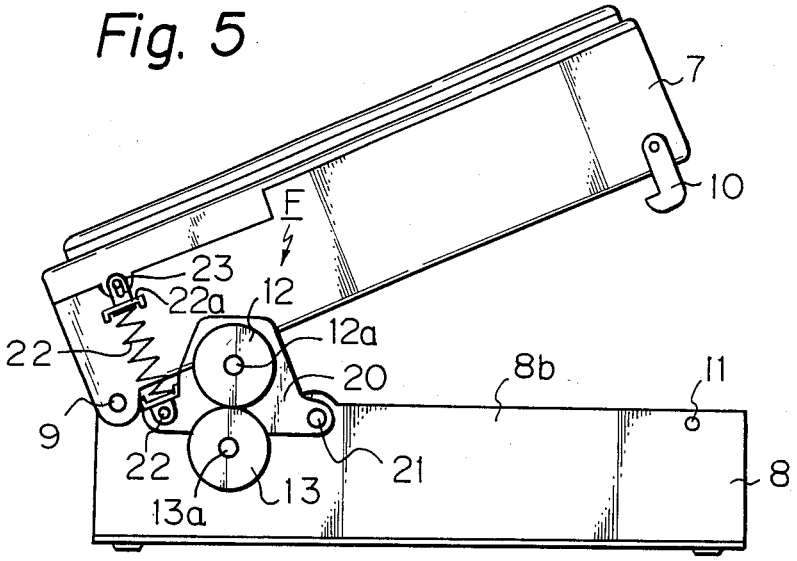
Figure 6:
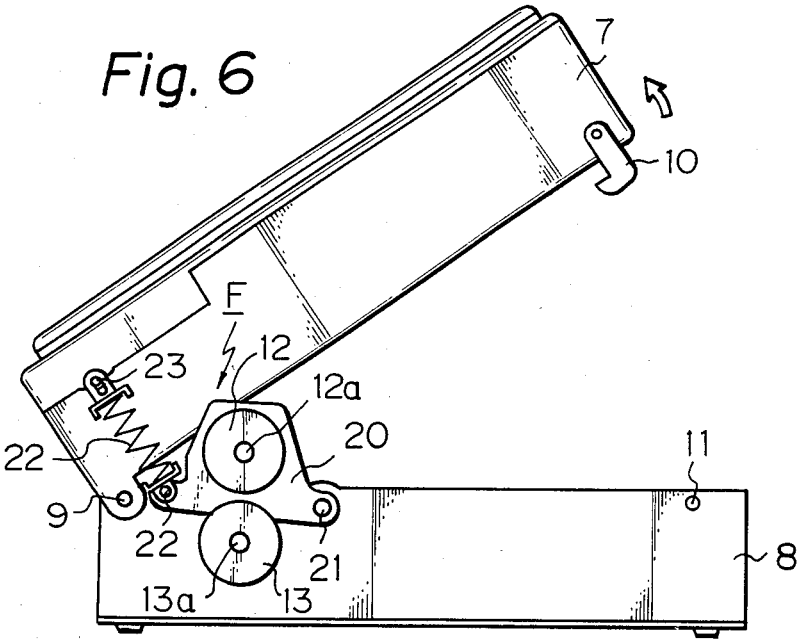

FIGS. 1 to 6 illustrate the principle of the present invention. FIGS. 1–3 show an example in which an upper roller is provided in an upper unit, and FIGS. 4–6 show an example in which a lower roller is provided in a lower unit.

Description will first be made of the example in which an upper roller is provided in an upper unit.

FIGS. 1–3 show the outline of a so-called crocodile mouth type copying apparatus in which an upper unit 7 is provided relative to a lower unit 8 so as to be upwardly pivotable and openable at one end about a hinge 9, and the positional relation of a pressure fixing device F. FIG. 1 shows a normal position in which the upper unit 7 is closed, FIG. 2 shows a position in which the upper unit is opened and stopped, and FIG. 3 shows a position in which the upper unit has been further raised from its opened and stopped position.

In FIGS. 1–3, reference numeral 10 designates a hook attached to the pivotable end side (the openable side) of the frame of the upper unit 7, and reference numeral 11 denotes a pin provided in the lower unit 8 correspondingly to the hook 10. The upper unit 7 is maintained in the closed position of FIG. 1 by the hook 10 being engaged with the pin 11.

The pressure fixing device will now be described. The pressure fixing device in the present example is disposed on the root side of the relative pivotal movement of the upper and lower units 7 and 8, and basically comprises a pair of rollers such as upper roller 12 and lower roller 13. The upper roller 12 is fixedly supported at the opposite ends of its shaft on the frame of the upper unit 7 through a bearing mechanism 12*a*, and the lower roller 13 is fixedly supported at the opposite ends of its shaft by a lower roller side plate 15 pivotable through a bearing mechanism 13*a*.

The lower roller side plate 15 is pivotally supported at one end thereof (the openable side thereof) on the frame 7*a* of the upper unit 7 by a fulcrum shaft 16 and is pivotably supported at the other end thereof (the non-openable side thereof) by a pressing spring 14 having an upwardly acting spring force through a spring pressure fulcrum shaft 17. Reference numeral 18 designates a fulcrum shaft for supporting the lower end 14*a* of the pressing spring 14 on the frame 8*a* of the lower unit 8.

In the present example, with the above-described construction, the fulcrum shaft 16 at one end of the lower roller side plate 15 is positioned on the pivotable and openable side of the upper unit 7, as compared with the fulcrum shaft 17 at the other end, whereby the pressing spring 14 is used not only as a pressing spring providing the mutual contact pressure of the pair of rollers 12 and 13 of the pressure fixing device F, but also as a support spring for the upper unit 7 when the upper unit 7 is upwardly opened and pivoted.

That is, if the hook 10 is disengaged from the pin 11 from the position of FIG. 1 when the maintenace of the interior of the machine such as jam processing or the like is necessary, the lower roller 13 is raised by the resilient force of the pressing spring 14 and the upper unit 7 is raised and pivoted about the hinge 9 through the upper roller 12 which is in contact with the lower roller 13, and the upper unit 7 is raised to and stopped at a position whereat the compression spring 14 is stopped by a stopper (not shown) for preventing the spring 14 from being stretched beyond a predetermined length (see FIG. 2). This is because, in this position, the downward pivotal movement of the upper unit 7 is supported by the raising force of the pressing spring 14.

If the upper unit 7 is manually raised further upwardly from the position of FIG. 2, there is created a gap between the upper roller 12 and the lower roller 13 (see FIG. 3) because the lower roller 13 has its upward movement from the position of FIG. 2 controlled by the stopper (not shown) of the compression spring 14, and this brings about improved operability for jammed paper processing as will later be described.

Also, in the above-described construction, the upper roller 12 and the lower roller 13 are supported by the frames, respectively, of the units 7 and 8 through the bearing mechanisms (or, as in the previous example, by the frames of the units through the lower roller side plate 15) and therefore, the torsional rigidity of the supporting portion is sufficiently great. Accordingly, the torsion based on the angle of intersection between the rollers which has heretofore been a great problem in reducing the weight of the pressure fixing device is effectively controlled by the above-described construction. Thus, it becomes possible to reduce the number of stays to be mounted along the lengthwise direction of the roller and to make the thickness of such stays smaller, and this is effective in reducing the weight of the fixing device and further of the image forming apparatus.

Further, the use of a single spring as both the pressing spring of the fixing device and the support spring of the upper unit as described above not only leads to a simplified structure and a greatly reduced number of parts, but also can release the mutual contact pressure between the pair of upper and lower rollers 12 and 13 when the upper unit 7 is opened, thereby facilitating the removal of jammed paper held between this pair of rollers. Also, it brings about the remarkable effect that the resistance of said removal can be made null by separating the pair of rollers from each other as shown in FIG. 3.

The example in which a lower roller is provided in a lower unit will now be described by reference to FIGS. 4–6. In these Figures, members similar to those in FIGS. 1–3 are given similar reference numerals and only the differences of this example from the above-described example will be described.

The pressure fixing device F in the present example is disposed on the root side of the relative opening and pivotal movement of the upper and lower units 7 and 8, and basically comprises a pair of upper roller 12 and lower roller 13. The lower roller 13 is supported at the opposite ends of its shaft by the frame of the lower unit 8 through the bearing mechanism 13*a*, and the upper roller 12 is fixedly supported at the opposite ends of its shaft by an upper roller side plate 20 through the bearing mechanism 12*a*.

The upper roller side plate 20 is pivotally supported at one end thereof (the openable side) on the frame 8*b* of the lower unit 8 by a fulcrum shaft 21 and is pivotably supported at the other end thereof (the non-openable side) by a pressing spring 22 having an upwardly acting spring force through a spring pressing fulcrum shaft 22. Reference numeral 23 designates a fulcrum shaft for supporting the upper end 22*a* of the pressing spring 22 on the frame of the upper unit 7.

Thus, again in the present example, with the above-described construction, the fulcrum shaft 21 at one end of the upper roller side plate 20 is positioned on the pivotable and openable side of the lower unit 8, as compared with the fulcrum shaft 22 at the other end, whereby the pressing spring 22 can be used not only as a pressing spring for providing the mutual contact pressure of the pair of rollers 12 and 13 of the pressure fixing device F, but also as a support spring for the upper unit 7 when the upper unit 7 is opened and pivoted upwardly.

Description will hereinafter be made by taking as an example a case where an embodiment of the present invention is applied to an electrophotographic copying apparatus.

Figure 7:
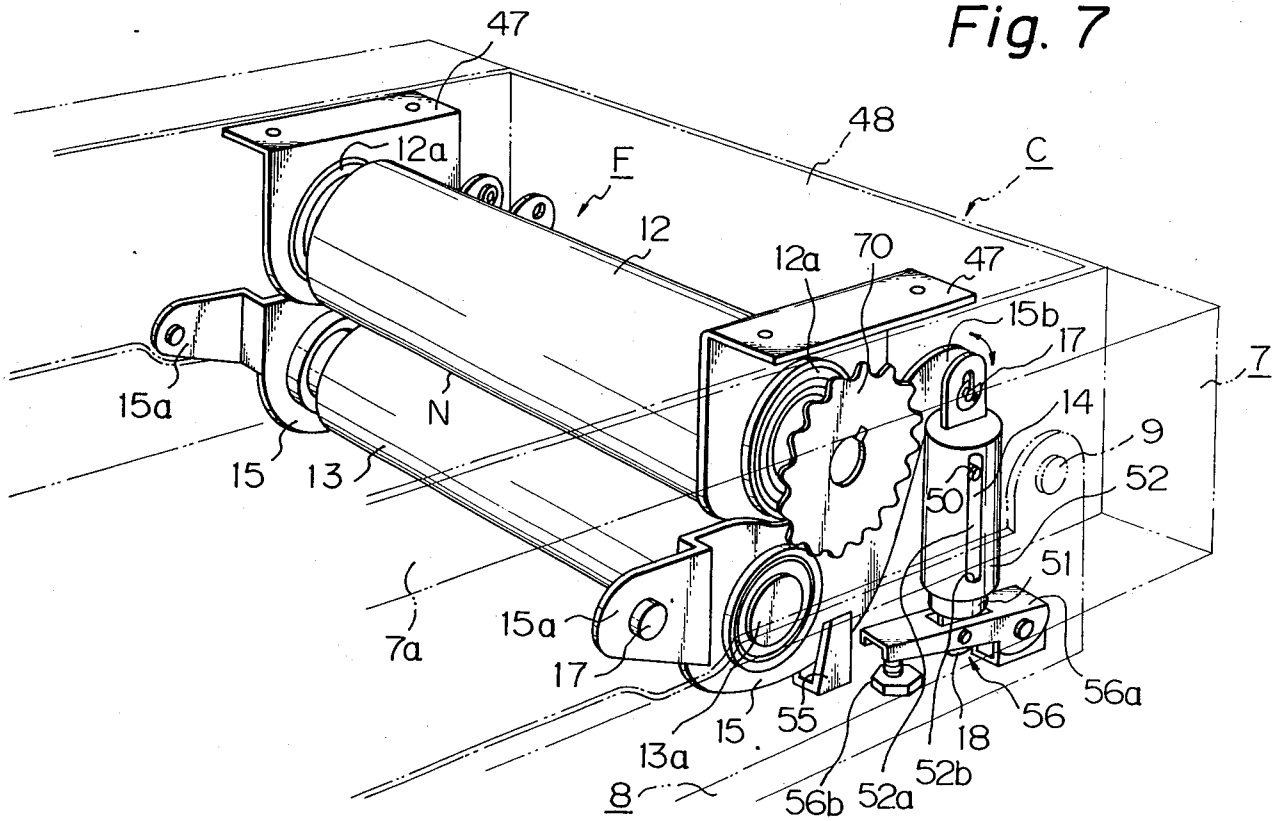
FIG. 7 is a perspective view of the essential portions of a copying apparatus to which an embodiment of the present invention is applied.
Figure 8:
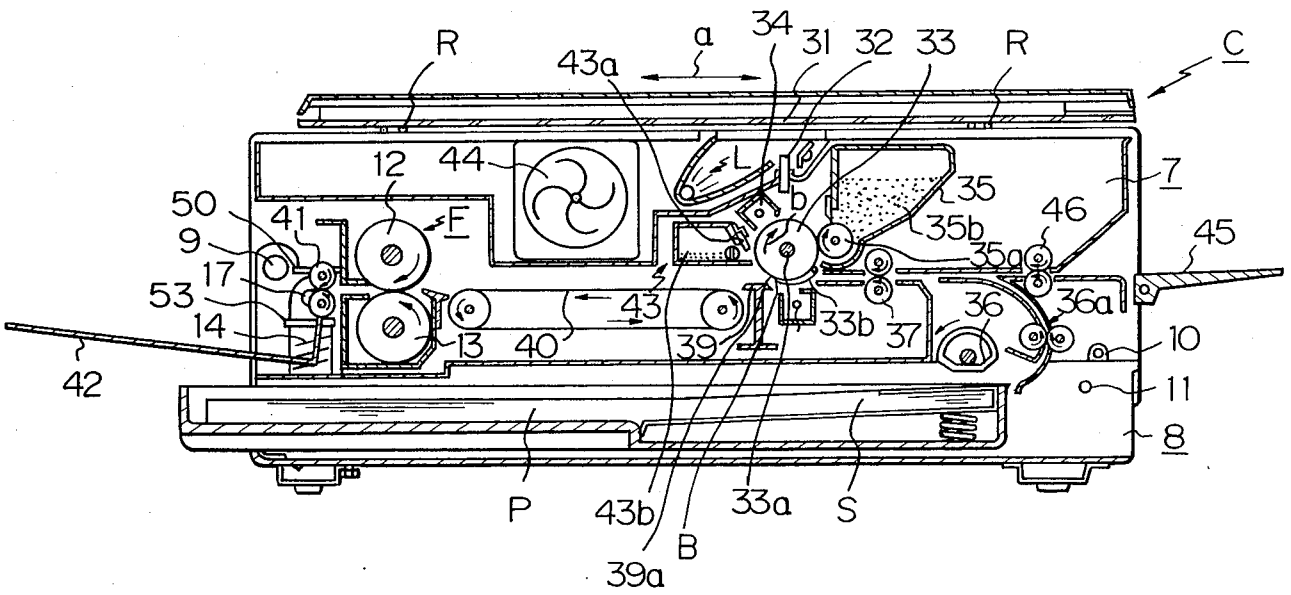
FIGS. 8 to 10 are cross-sectional views of a copying apparatus to which an embodiment of the present invention is applied.
Figure 9:
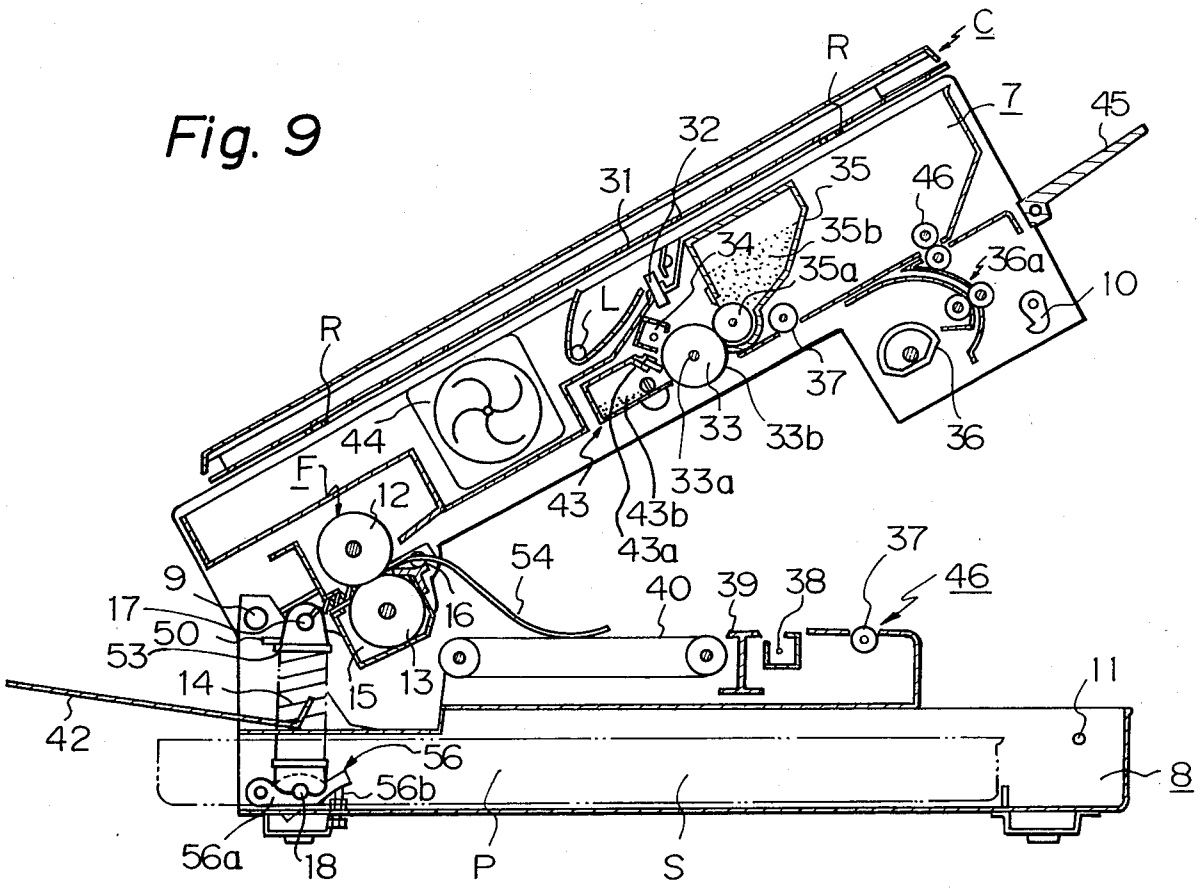
Figure 10:
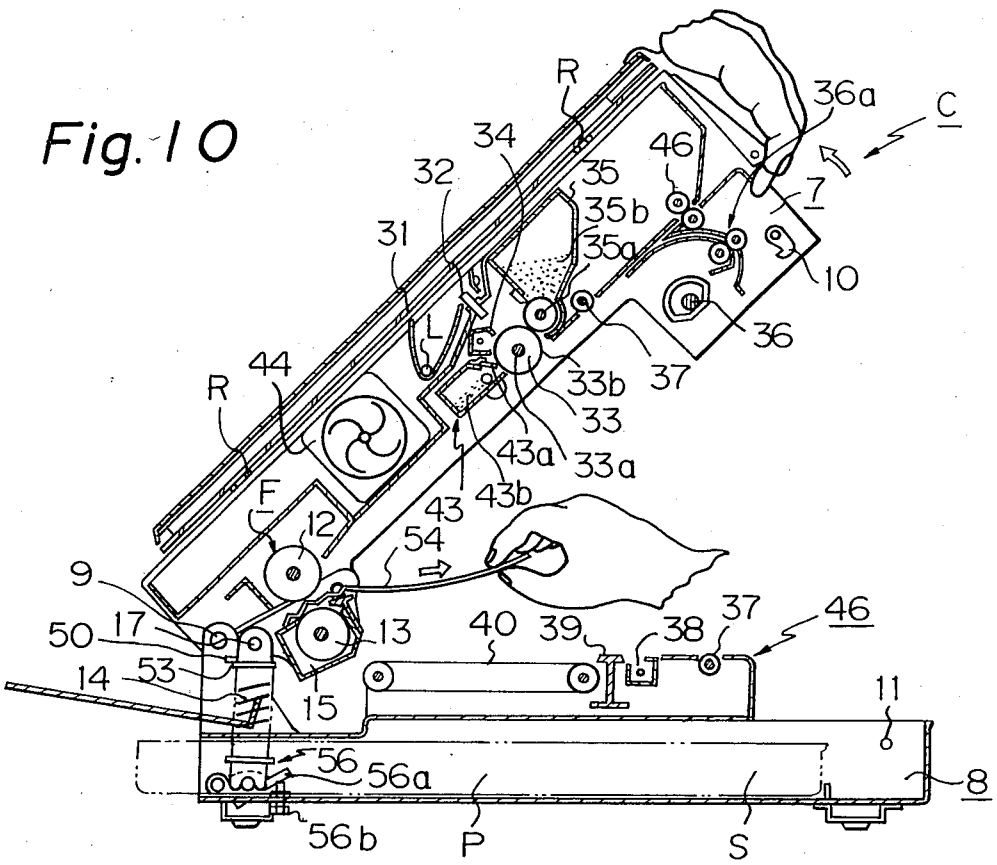

FIG. 7 is a fragmentary perspective view of the vicinity of the fixing device F of a copying apparatus C to which an embodiment of the present invention is applied, and FIGS. 8 to 10 are cross-sectional views of the copying apparatus. FIG. 8 shows a position in which the copying apparatus C is closed, FIG. 9 shows a position in which the body of the copying apparatus is vertically opened, and FIG. 10 shows a position in which the body of the copying apparatus C is further opened by manual operation for jam processing. In FIG. 7, the outer cover of the copying apparatus body C is not shown.

In these Figures, reference numeral 31 designates an original supporting table formed of a transparent material such as glass and reciprocally movable on rails R in the directions of double-headed arrow a. Reference numeral 32 denotes a short-focus small-diameter imaging element array. The image of an original (not shown) placed on the original supporting table 31 is illuminated by an illuminating lamp L and the reflected optical image thereof is slit-projected onto a photosensitive drum 33 by the array 32. The photosensitive drum 33 is rotated in the direction of arrow b about a shaft 33*a*. Reference numeral 34 designates a charger for uniformly charging the photosensitive drum 33 coated, for example, with a zinc oxide photosensitive layer or an organic semi-conductor photosensitive layer 33*b*. The drum 33 uniformly charged by the charger 34 is subjected to image exposure by the element array 32, whereby an electrostatic latent image is formed on the drum 33. This electrostatic latent image is then developed into a visible image by a developing device comprising a magnet roller 35*a* and a toner reservoir 35*b*. On the other hand, a sheet P contained in a casset S is fed onto the photosensitive drum 33 by a pair of register rollers 37 rotated so as to be synchronized with a feed roller 36, a pair of conveyor rollers 36*a* and the image on the photosensitive drum 33. The toner image on the photosensitive drum 33 is transferred onto the sheet P by a transfer discharger 38. Thereafter, the sheet P is separated from the drum 33 by separating means 39*a* (for example, a separating belt B shown in FIG. 8 or a separating corona discharger) and is directed to the fixing device F by a guide 39 and a conveyor belt 40, and the toner image on the sheet P is fixed, whereafter the sheet P is discharged onto a tray 42 by a pair of discharge rollers 41. Any toner remaining on the drum 33 after the transfer of the toner image is removed by a cleaner 43. This cleaner 43 comprises a blade 43*a* and a toner reservoir 43*b*.

Reference numeral 44 designates a cooling fan, reference numeral 45 denotes a manual paper feeding bed, and reference numeral 46 designates a conveyor roller for conveying manually fed sheets toward the drum 33.

As previously described, this copying apparatus C is divided into an upper housing 7 and a lower housing 8 which are coupled together by a support shaft 9, as shown in FIG. 8, and the upper housing 7 is designed to be upwardly pivoted about the support shaft 9 by a spring 14. Within the upper housing 7, there are disposed process means such as the illuminating optical system (32,L), the photosensitive drum 33, the developing device 35 and the cleaner 43. Within the lower housing 8, there are disposed the feed roller 36, the transfer discharger 38, the separating means 39*a*, the guide 39 and the fixing device F along the sheet conveyance path. By upwardly pivoting the upper housing 7, the sheet conveyance path 46 is opened.

The constructions of the upper housing 7, the lower housing 8 and the fixing device F of the copying apparatus C will now be described in detail by reference to FIG. 7. The state shown in FIG. 7 is a state in which the upper housing 7 and the lower housing 8 are closed together.

In FIG. 7, reference numeral 47 designates an upper fixing roller supporting plate secured to the top plate 48 of the upper housing 7. An upper fixing roller 12 is rotatably mounted on the supporting plate 47 by a bearing 12*a*. The bearing 12*a* is secured to the supporting plate 47. Reference numeral 15 designates a lower fixing roller side plate. A lower fixing roller 13 is rotatably mounted on this side plate 15 by a bearing 13*a*. The bearing 13*a* is secured to the side plate 15. This side plate 15 has one end 15*a* thereof on the openable side of the body pivotally supported on the frame 7*a* of the upper housing 7 by a shaft 17 and a pressing spring 14 is restrained on the other end 15*b* thereof (on the nonopenable side of the body) through the spring pressing fulcrum shaft 17. Thus, the side plate 15 is pivotable about the shaft 17 and is normally subjected to an upward raising force by the spring 14.

Accordingly, in the state in which the upper and lower housings 7 and 8 are closed together, that is, in the state in which the hook 10 of the upper housing 7 is engaged with the pin 11 of the lower housing 8, the pivotable side plate 15 normally subjected to the raising force by the spring 14 is stopped in a state in which the lower roller 13 mounted at the fixed position thereof bears against the the upper roller 12 provided at the fixed position of the supporting plate 47 and its upward movement is controlled thereby. Accordingly, by the raising force of the spring 14, the lower roller 13 is pressed against the upper roller 12 with a relatively strong predetermined pressure, so that a nip N of a sufficient width to fix the toner image on the sheet P is formed between the rollers 12 and 13 even if these rollers 12 and 13 are rotated at a relatively high speed by a motor (not shown). The width of the nip N refers to the width of the nip with respect to the direction of rotation of the rollers 12 and 13, in other words, the direction of conveyance of the sheet P.

Accordingly, the sheet P to which the toner image on the photosensitive drum 33 has been transferred has the toner image thereon fixed on the surface thereof by the pressure between the rollers 12 and 13 in the process of being held between and conveyed by the rollers 12 and 13. Thereafter, the sheet P having the toner image thus fixed thereon is discharged onto the tray 42 by rotation of discharge rollers 41. The rotation of the rollers 12 and 13 is accomplished by the drive from a motor (not shown) being transmitted to a gear 70 through a gear train (not shown) to rotate the roller 12 and the roller 13 following the rotation of the roller 12.

The operation of opening the body will now be described by reference to FIGS. 9 and 10.

Where unsatisfactory conveyance of a sheet being conveyed has occurred during a series of copying operations, the hook 10 may be disengaged from the pin 11 and the upper housing 7 may be opened upwardly to thereby open the interior of the body and the jammed sheet may be removed. That is, when the hook 10 is disengaged from the pin 11, the raising force of the spring 14 is transmitted to the pivotable side plate 15→the lower roller 13→the upper roller 12→the supporting plate 47→the upper housing 7, and the upper housihg 7 is opened relative to the lower housing 8. That is, if the hook 10 is released from the pin 11 from the closed state of the body of FIGS. 7 and 8 when maintenance of the interior of the machine such as jam processing is necessary, the pressing spring 14 raises the upper housing 7 about the hinge 9, and the upper housing 7 is raised to a position at which it is stopped by a stopper 50 adapted to prevent the compression spring 14 from being stretched beyond a predetermined length, and is stopped at that position (see FIG. 9). In this state, the downward pivotal movement of the upper housing is supported by the pressing spring 14 and the open position of the upper housing 7 is maintained.

Different examples of the stopper mechanism for the spring 14 are shown in FIGS. 7 and 8–10. That is, the example shown in FIG. 7 is one in which an upper cylinder 52 is pivotably fitted in a lower cylinder 51 containing the spring 14 therein and a fixed stopper 50 is engaged with the slot 52*a* of the upper cylinder 52. When the upper cylinder 52 is raised by the raising force of the spring 14 and the lower end 52*b* of the slot 52*a* thereof strikes against the stopper 50, the stretching of the spring 14 is controlled. The example shown in FIGS. 8–10 is one in which the upward movement of the upper end plate 53 of the spring 14 is stopped by a fixed stopper 50 to thereby control the stretching of the spring 14. By any of these stopper mechanisms, the stretching of the spring 14 can be reliably controlled.

Now, in the state in which the upper housing 7 is raised to and stopped at the position whereat the stretching of the spring 14 is thus stopped by the stopper 50 (see FIG. 9), the pressure between the upper and lower fixing rollers 12 and 13 is reduced but the holding pressure between these two rollers 12 and 13 is left. Therefore, the jammed sheet in the conveyance path 40 before it reaches the fixing device F can be easily removed, but there is left a resistance (holding pressure) to remove the sheet 54 held between the two rollers 12 and 13.

Thus, in the present embodiment, in such a case, if the upper housing 7 is manually raised slightly, the lower fixing roller 13 cannot move upwardly because the pressing spring 14 has its further stretching suppressed by the spring stopper 50, and a gap is created between the upper fixing roller 12 and the lower fixing roller 13 to enable the jammed sheet 54 to be removed very simply without the sheet 54 being damaged.

As described above, in the present embodiment, not only the spring 14 can be caused to act to open the upper housing 7 and act for the pressing between the two fixing rollers, but also the upper housing 7 can be raised further upwardly from the raising position of the spring 14.

Further, in the present embodiment, reference numeral 55 designates a guide for preventing leftward and rightward vibration of the supporting plate 15 when it pivotally moves. Reference numeral 56 denotes a spring pressure adjusting mechanism capable of adjusting the strength of the spring 14 by adjusting the level of a lever 56*a* pivotable about a shaft 56*a* and holding the fulcrum shaft 18 of the spring 14.

In the case of the embodiment shown in FIG. 7, when the spring force of the spring 14 is, for example, 75 Kg, a linear pressure of the order of 12 Kg/cm and a total pressure force of the order of 300 Kg for B4 size can be readily obtained. However, the present invention is not restricted thereto, but of course, the spring force may be suitably chosen.

Figure 11:
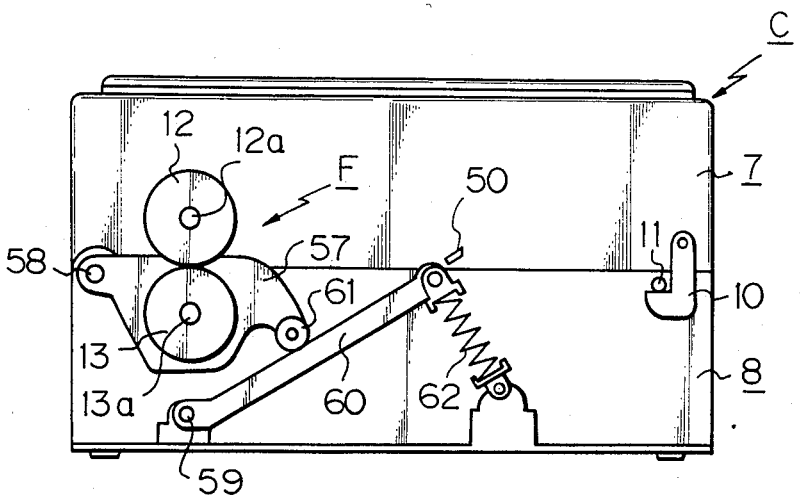
FIG. 11 is a side view of a copying apparatus to which another embodiment of the present invention is applied.

Still another embodiment of the present invention will now be described by reference to FIG. 11. Referring to FIG. 11 which shows still another embodiment of the present invention, one end of a lower roller side plate 57 supporting the lower roller 13 is coaxially supported by a hinge 58 which pivotally supports the lower housing 8 and the upper housing 7. The other end of the lower roller side plate 57 is engaged with the upper surface of an inclined link 60 pivotally supported by a support shaft 59 provided in the lower housing 8, through a roller 61, and the link 60 is designed to push up the roller 61 (i.e., the other end of the lower roller side plate 57) by the pressure force of a pressing spring 62. One end of the spring 62 is engaged with the link 60 and the other end thereof is engaged with the lower housing 8.

Again in the present embodiment, the spring force can be used for a double purpose and the upper housing can be raised more upwardly than the raising position by the spring force.

Yet still another embodiment will be shown below.

The embodiment which will hereinafter be described is one in which the lower fixing roller is provided in the lower housing. In this embodiment, members functionally similar to those shown in FIGS. 4–6 are given similar reference numerals.

Figure 12:
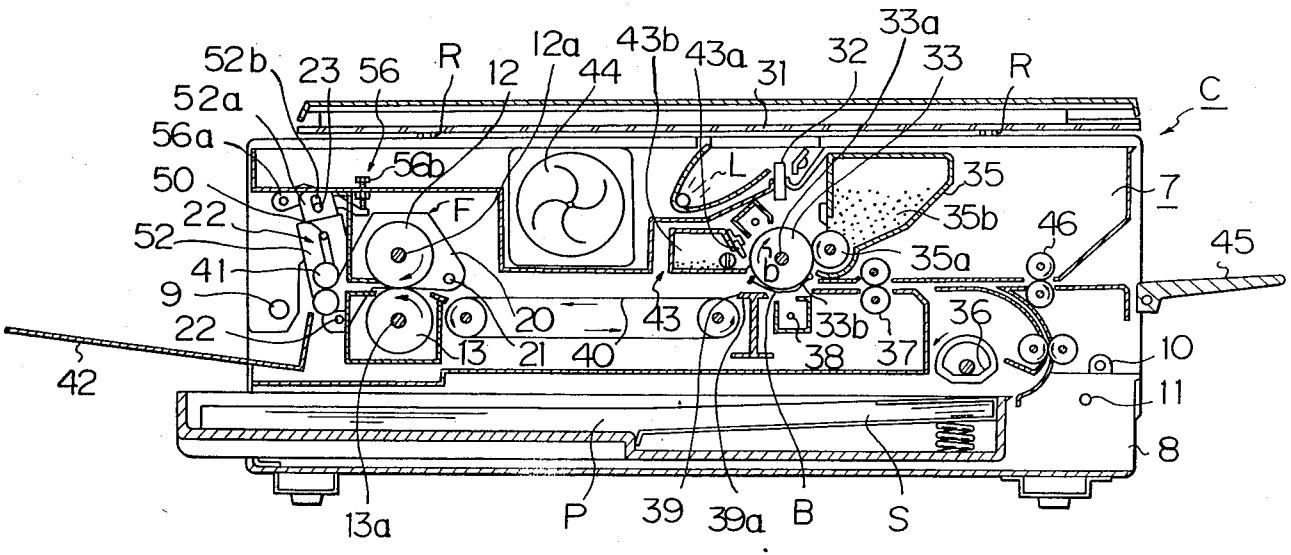
FIGS. 12 to 14 are cross-sectional views of a copying apparatus to which still another embodiment of the present invention is applied.
Figure 13:
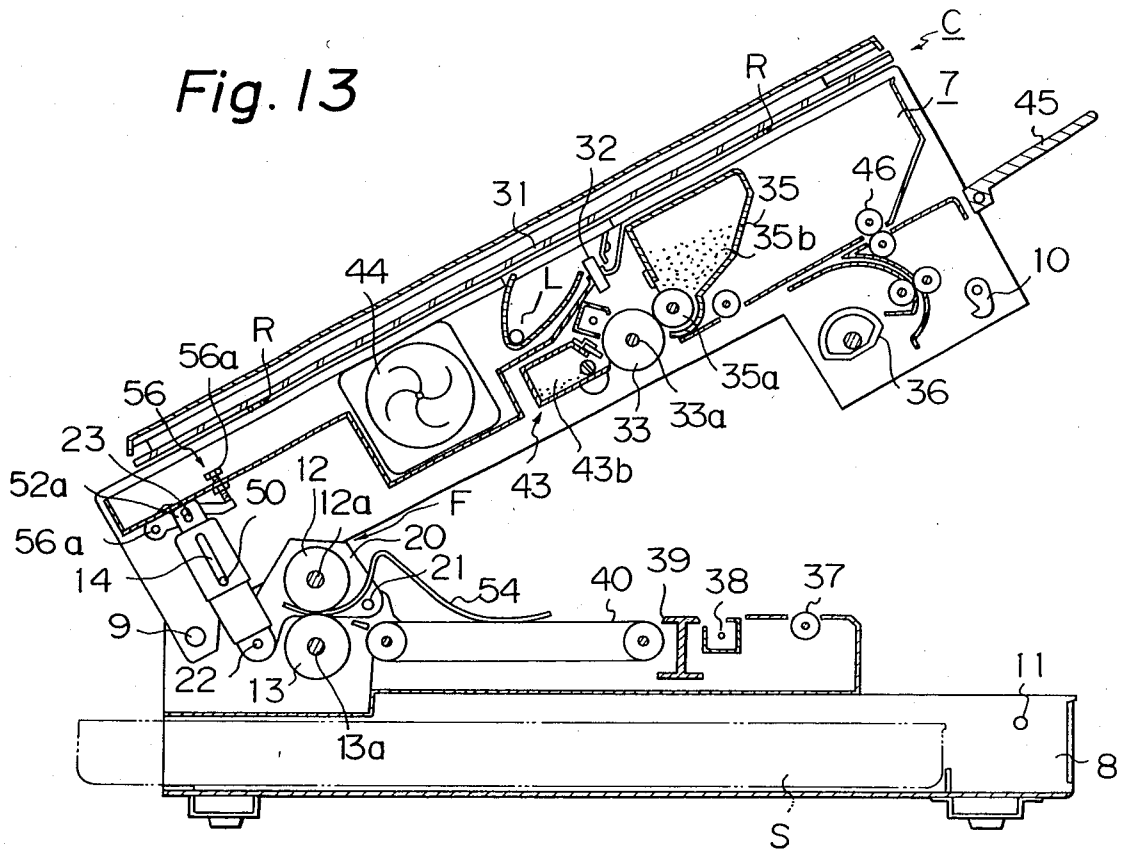
Figure 14:
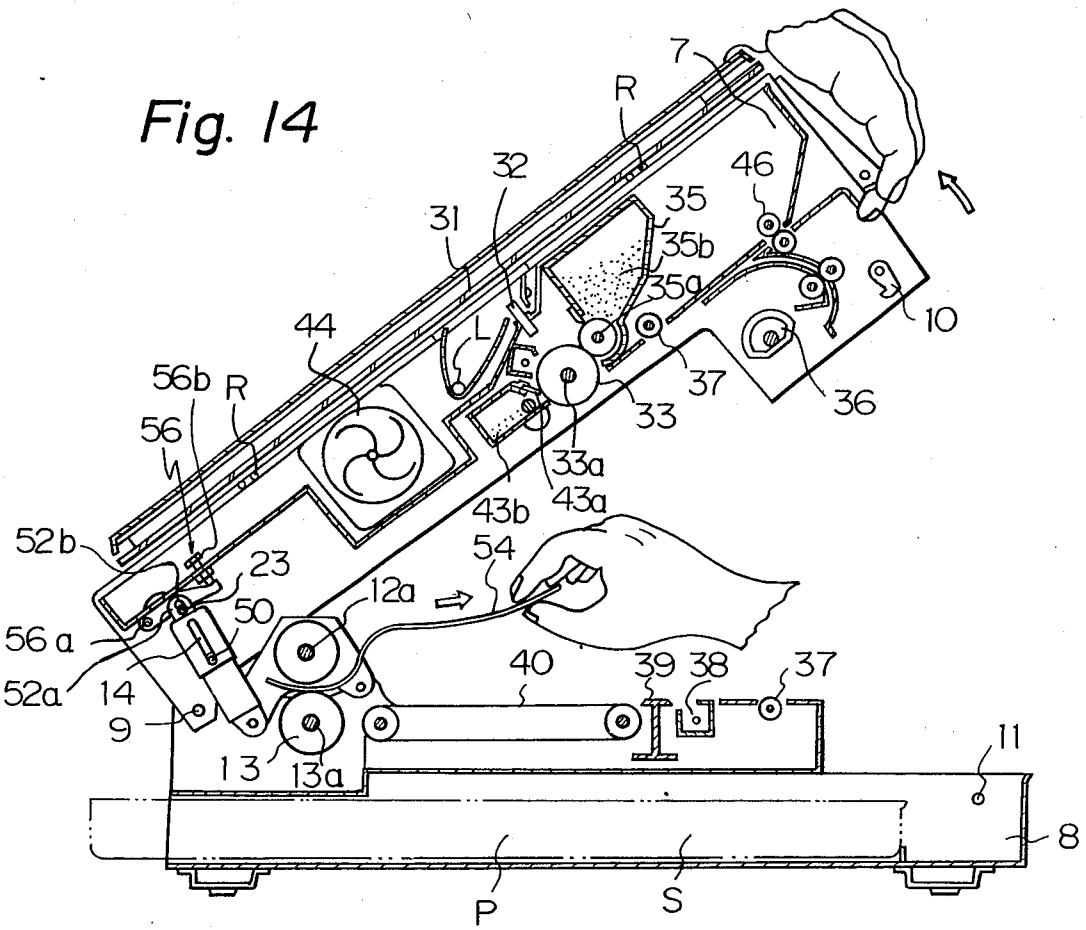

FIGS. 12 to 14 show the outline of a so-called crocodile mouth type copying apparatus in which relative to the lower housing 8, the upper housing 7 is provided so as to be upwardly pivotable and openable at one end thereof about the hinge 9 and the positional relation of the pressure fixing device F. FIG. 12 shows a normal position in which the upper housing 7 is closed, FIG. 13 shows a position in which opening of the upper housing 7 is stopped, and FIG. 14 shows a position in which the upper housing 7 has been further raised from the position in which opening thereof is stopped.

In these Figures, the pressure fixing device F is disposed at the root side of the relative opening and pivotal movement of the upper and lower housings 7 and 8 and basically comprises a pair of upper roller 12 and lower roller 13. The lower roller 13 is supported at the opposite ends of its shaft by the frame (not shown) of the lower housing 8 through bearings 13*a*, and the upper roller 12 is supported at the opposite ends of its shaft at the fixed position of an upper roller side plate 20 through bearings 12*a*.

The upper roller side plate 20 is pivotally supported at one end thereof on the frame (not shown) of the lower housing 8 by a fulcrum shaft 21 and is supported at the other end thereof by a pressing spring 22 having an upwardly acting spring force through a spring pressing fulcrum shaft 22. Designated by 23 is a fulcrum shaft for supporting the upper engaging end portion 52*a* of an upper cylinder 52 containing the pressing spring 22 therein, on the frame (not shown) of the upper housing 7. Accordingly, in the position in which the upper and lower housings 7 and 8 are closed together, that is, in the position in which the hook 10 of the upper housing 7 is engaged with the pin 11 of the lower housing 8, by the spring force of the spring 22, the pivotable side plate 20 urges the upper roller 12 mounted at the fixed position thereof against the lower roller 13 provided at the fixed position of the lower housing 8 and is stopped in a state in which the upward movement thereof is controlled. Thus, the two rollers 12 and 13 assume their position in which they can effect fixation.

In the present embodiment, with the above-described construction, the fulcrum shaft 21 at one end of the upper roller side plate 20 is positioned on the pivotable and openable side of the lower housing 8 as compared with the other end thereof, whereby the pressing spring 22 can be used not only as a pressing spring for providing the mutual contact pressure of the pair of rollers of the pressure fixing device F, but also as a support spring for the upper housing 7 when the upper housing 7 is upwardly opened and pivoted.

That is, if the hook 10 is released from the pin 11 from the position of FIG. 12 when maintenance of the interior of the machine such as jam processing is necessary, the pressing spring 22 raises the upper housing 7 about the hinge 9 and the upper housing 7 is raised to a position in which it is stopped by a stopper 50 for preventing the compression spring 22 from being stretched beyond a predetermined length, and is stopped at that postion (see FIG. 13).

This is because, in this state, the downward pivotal movement of the upper housing 7 is supported by the pressing spring 22. In this state, the jammed sheet in the conveyance path before it reaches the fixing device F can be removed, but in the jammed sheet 54 held by the pressure fixing device F, there is still left a resistance (holding pressure) to the removal thereof even if the pressure between the rollers 12 and 13 is reduced. Therefore, if the upper housing 7 is manually raised slightly as shown in FIG. 14, further stretching of the pressing spring 22 is suppressed by the spring stopper 50 and thus, a gap is created between the upper fixing roller 12 and the lower fixing roller 13 to thereby enable the jammed sheet 54 to be removed without being damaged. In the present embodiment, the fulcrum shaft 23 is engaged with a slot 52*b* provided in the upper engaging end portion 52*a* of the upper cylinder 52. Thus, the upper housing 7 maintained in its opened position by the raising force of the spring 22 can be manually raised until the shaft 23 strikes against the upper end of the slot 52*b* (see FIG. 14). Also, in a state in which the shaft 23 bears against the lower end of the slot 52*b*, the resilient force of the spring 22 can be transmitted to the upper housing.

Figure 15:
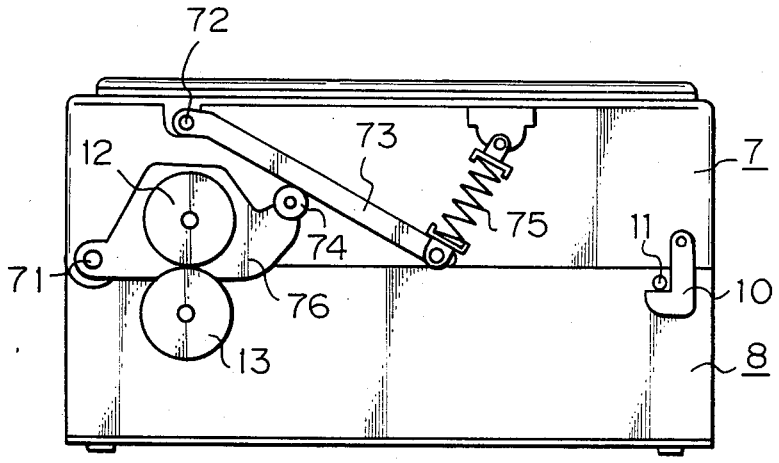
FIGS. 15 to 17 are side views of a copying apparatus to which yet still another embodiment of the present invention is applied.

FIG. 15 shows another embodiment of the present invention. In FIG. 15, one end of an upper roller side plate 76 supporting the upper roller 12 is coaxially supported on a hinge 71 which pivotally supports the upper housing 7 and the lower housing 8. The other end of the upper roller side plate 76 is engaged with the upper surface of an inclined link 73 supported on a support shaft 72 provided in the upper housing 7, through a roller 74, and the link 73 is designed to push up the roller 74 (i.e., the other end of the upper roller side plate 76) by the spring force of a pressing spring 75. One end of the spring 75 is engaged with the link 73 and the other end thereof is engaged with the upper housing 7.

It will be apparent that again in this case, an effect similar to that of the previously described embodiments can be obtained.

Figure 16:
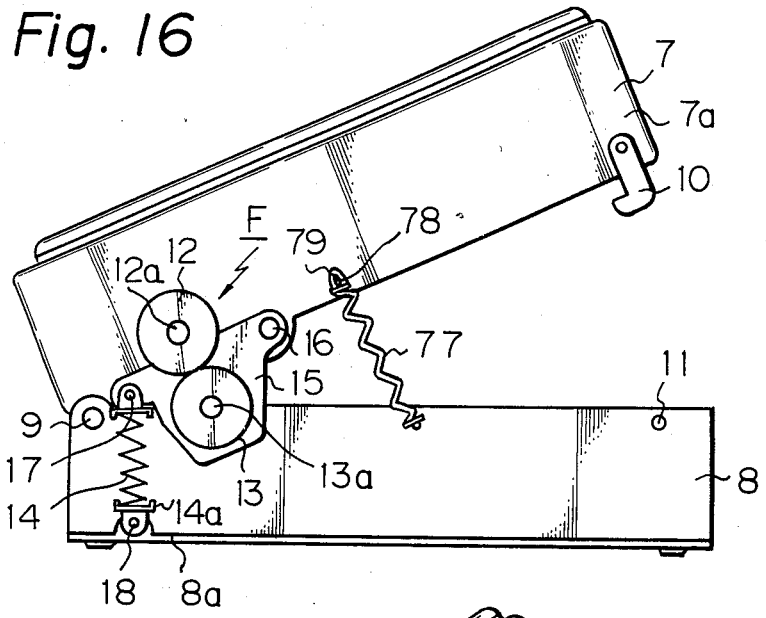
Figure 17:
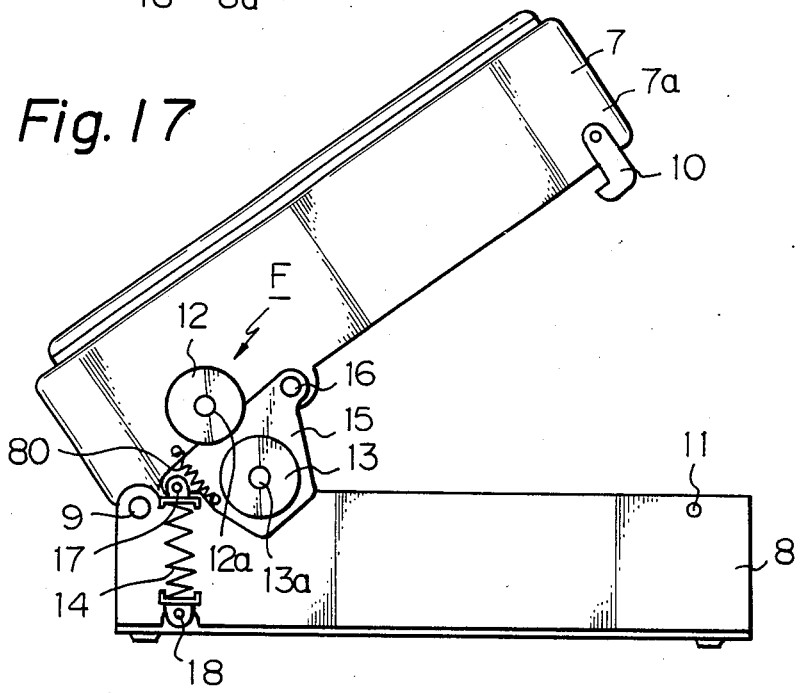

Further embodiments of the present invention are shown in FIGS. 16 and 17. Both of these embodiments employ an auxiliary spring.

The embodiment shown in FIG. 16 in one in which, in the example shown in FIG. 2, an auxiliary spring 77 is further provided between the upper housing 7 and the lower housing 8 and on the openable pivotable side of the body. In this embodiment, the raising force of the spring 14 and the raising force of the auxiliary spring 77 cooperate with each other and therefore, even if the weight of the upper housing is great, the upper housing 7 can be smoothly raised and the opened position of the upper housing 7 can be reliably maintained. In the present embodiment, the strength of the auxiliary spring 77 is set so as to be balanced with the weight of the upper housing 7 when it cooperates with the spring 14 to raise the upper housing 7. Thus, in the present embodiment, as shown, the upper housing 7 maintains its opened position with the weight of the upper housing 7 balanced with the spring forces of the springs 14 and 77. Further, if required, the dowel 78 of the upper housing 7 and the spring 77 may be engaged with each other in a slot 79, whereby the upper housing 7 may be further raised to separate the rollers 12 and 13 from each other. In the present embodiment, if the strength of the auxiliary spring 77 is made greater, it will be possible to raise the upper housing 7 to a position in which the rollers 12 and 13 are spaced apart from each other.

The embodiment shown in FIG. 17 is one in which an auxiliary spring 80 is provided adjacent to the hinge 9 and between the upper housing 7 and the lower housing 8. In this embodiment, the upper housing 7 opened by the forces of the springs 14 and 80 is further raised by the force of the auxiliary spring 80 and the opened position of the upper housing 7 is maintained with the rollers 12 and 13 spaced apart from each other. In the present embodiment, the upper housing 7 can be raised to a position in which the rollers 12 and 13 are spaced apart from each other, by the spring force.

In each of the above-described embodiments, it is not always requisite to provide the stopper for controlling the stretching of the spring, but by suitably choosing the natural length or the strength of the spring, it is also possible to maintain the opened position of the upper housing when the spring has stretched to its natural length or when the strength of the spring has become balanced with the weight of the upper housing. The construction for opening the body until the two fixing rollers as rotatable members are spaced apart from each other is not always necessary, but may be suitably provided. Particularly in the case of a heat fixing device, such construction is not always necessary. Also, an example in which the upper roller is provided on the supporting plate has been shown in FIG. 7, whereas the present invention is not restricted thereto, but the upper roller may also be mounted directly in the upper housing. Further, in each of the above-described embodiments, there has been shown an example in which one end of the pivotable side plate supporting the upper roller or the lower roller is mounted directly on the upper housing or the lower housing, whereas the method of mounting the pivotable side plate is not restricted thereto, but the pivotable side plate may also be mounted indirectly on the upper housing or the lower housing, for example, through the unit side plate or the like of the fixing device. Also, in each of the above-described embodiments, there has been shown an example in which the apparatus body is divided into a lower housing which supports the entire apparatus and an upper housing openable relative to the lower housing, whereas the present invention is not restricted thereto, but the apparatus body may also be divided, for example, into a left housing which holds the entire apparatus and a right housing openable relative to the left housing, or may be divided into three housings. The resilient means acting when the body is opened is not restricted to the compression spring, but use may also be made of a coil spring, a torsion spring, a tension spring or rubber. The image forming means is neither restricted to that shown in each embodiment, but for example, besides the photosensitive drum, it may be in the form of an insulating drum or a belt. Further, other conventional image forming means in which the developing portion and the cleaning portion are integral with each other or image transfer and fixation are effected at a time is also applicable. Furthermore, in the above-described embodiments, a pressure fixing device has been shown as an example and therefore, the material used for the rotatable members is carbon steel having its surface plated with chromium, whereas the present invention is not restricted thereto, but for example, in the case of a heat fixing device, the material of the rotatable members may be rubber, sponge or the like. Also, in the present invention, the resilient means is only required to open the body, and any means which contributes to one of the process of opening the body and the process of maintaining the body in its opened position is included in the present invention. Accordingly, even an example in which the body after being opened is maintained in its opened position with the stay or bar being made upright is included in the present invention if the resilient means contributes to it in the process of opening the body.

As described above, the present invention provides an image forming apparatus having resilient means acting for opening of the body and acting for pressing between the fixing rotatable members.

We claim:

1. An image forming apparatus comprising:
- a housing capable of being divided to open, said housing having,
- a first housing,
- a second housing openable and closable with respect to said first housing around an axis,
- image forming means for forming on an image bearing member a toner image corresponding to image information to be recorded, and
- fixing means for fixing the toner image formed on said image bearing member, said fixing means comprising first and second rotatable members for conveying said image bearing member while pinching and pressing it;
- locking means for locking said second housing to said first housing; and
- resilient means for pressing said first rotatable member and said second rotatable member when the second housing is locked by said locking means to the first housing, and for urging said second housing to open it with respect to the first housing when said locking means is released.

2. An apparatus according to claim 1, wherein said resilient means has such a resilient force that said second housing may be kept open relative to said first housing and said second housing may be supported thereby.

3. An apparatus according to claim 1, wherein said apparatus further comprises a second resilient means provided independently of said first resilient means, said second resilient means having such a resilient force that said second housing may be assisted thereby to open, said second housing may be kept open relative to said first housing, and said second housing may be supported thereby.

4. An apparatus according to claim 1, wherein said fixing means is pressure fixing means.

5. An image forming apparatus comprising:
- a housing capable of being divided to open, said housing having,
- a first housing,
- a second housing openable and closable with respect to said first housing around an axis,
- image forming means for forming on an image bearing member a toner image corresponding to image information to be recorded, and
- fixing means for fixing the toner image formed on said image bearing member, said fixing means comprising first and second rotatable members for conveying said image bearing member while pinching and pressing it, and support means for supporting said first rotatable member rotatably, said second rotatable member being rotatably supported on the second housing side, an end of said support means being rockably supported on the second housing;
- resilient means connected to said first housing at one end thereof and to said support means at the other end thereof, said resilient means providing a pressing force between said first rotatable member and said second rotatable member when said second housing is closed with respect to the first housing, said resilient means also providing said second housing with an opening force when said second housing is opened with respect to the first housing.

6. An apparatus according to claim 5, wherein said resilient means has such a resilient force that said second housing may be kept open relative to said first housing and said second housing may be supported thereby.

7. An apparatus according to 5, wherein said apparatus further comprises stopper means for limiting the extension of said resilient means, and said second housing being further openable with respect to the first housing after said stopper means has stopped the extension of said resilient means.

8. An apparatus according to claim 5, wherein said apparatus further comprises a second resflient means provided independently of said first resilient means, said second resilient means having such a resilient force that said second housing may be assisted thereby to open, said second housing may be kept open relative to said first housing, and said second housing may be supported thereby.

9. An apparatus according to claim 5, wherein said fixing means is pressure fixing means.

10. An apparatus according to claim 5, wherein said apparatus further comprises locking means for locking said second housing to said first housing.

11. An image forming apparatus comprising:
- a housing capable of being divided to open, said housing having,
- a first housing,
- a second housing openable and closable with respect to said first housing around an axis,
- image forming means for forming on an image bearing member a toner image corresponding to image information to be recorded, and
- fixing means for fixing the toner image formed on said image bearing member, said fixing means comprising first and second rotatable members for conveying said image bearing member while pinching and pressing it, and support means for supporting said second rotatable member rotatably, said first rotatable member being rotatably supported on the first housing side, an end of said support means being rockably supported on the first housing;
- resilient means connected to said second one end thereof and to said support means at the other end thereof, said resilient means providing a pressing force between said first rotatable member and said second rotatable member when said second housing is closed with respect to the first housing, said resilient means also providing said second housing with an opening force when said second housing is opened with respect to the first housing.

12. An apparatus according to claim 11, wherein said resilient means has such a resilient force that said second housing may be kept open relative to said first housing and said second housing may be supported thereby.

13. An apparatus according to claim 11, wherein said apparatus further comprises stopper means for limiting the extension of said resilient means, and said second housing being further openable with respect to the first housing after said stopper means has stopped the extension of said resilient means.

14. An apparatus according to claim 11, wherein said apparatus further comprises a second resilient means provided independently of said first resilient means, said second resilient means having such a resilient force that said second housing may be assisted thereby to open, said second housing may be kept open relative to said first housing, and said second housing may be supported thereby.

15. An apparatus according to claim 11, wherein said fixing means is pressure fixing means.

16. An apparatus according 11, wherein said apparatus further comprises locking means for locking said second housing to said first housing.

* * * * *

UNITED STATES PATENT AND TRADEMARK OFFICE

CERTIFICATE OF CORRECTION

PATENT NO. : 4,589,758

DATED : May 20, 1986

INVENTOR(S) : NOBUHIRO KASAMA, ET AL.

It is certified that error appears in the above-identified patent and that said Letters Patent is hereby corrected as shown below:

Column 2, line 32, change "ratatable" to --rotatable--.

Column 6, line 52, change "housihg" to --housing--.

Claim 11, line 19 (Column 12, line 52) after "second" insert --housing at--.

Signed and Sealed this

*Twelfth* Day of *August 1986*

[SEAL]

*Attest:*

DONALD J. QUIGG

*Attesting Officer*

*Commissioner of Patents and Trademarks*